US009995495B2

(12) United States Patent
Edens et al.

(10) Patent No.: US 9,995,495 B2
(45) Date of Patent: Jun. 12, 2018

(54) SYSTEM AND METHOD FOR HVAC CONDENSATE MANAGEMENT

(71) Applicant: Trane International Inc., Piscataway, NJ (US)

(72) Inventors: John Raymond Edens, Kilgore, TX (US); Jonathan Edward Thrift, Jacksonville, TX (US); Bradley Lynn Kersh, Flint, TX (US)

(73) Assignee: Trane International Inc., Piscataway, NY (US)

( * ) Notice: Subject to any disclaimer, the term of this patent is extended or adjusted under 35 U.S.C. 154(b) by 299 days.

(21) Appl. No.: 15/010,569

(22) Filed: Jan. 29, 2016

(65) Prior Publication Data

US 2016/0146475 A1 May 26, 2016

Related U.S. Application Data

(62) Division of application No. 13/730,584, filed on Dec. 28, 2012, now Pat. No. 9,279,620.

(60) Provisional application No. 61/581,882, filed on Dec. 30, 2011.

(51) Int. Cl.

| | |
|---|---|
| ***F24F 13/22*** | (2006.01) |
| ***F24F 1/00*** | (2011.01) |
| ***F28D 7/02*** | (2006.01) |
| ***F28F 13/06*** | (2006.01) |
| ***F28F 17/00*** | (2006.01) |
| ***F28D 1/047*** | (2006.01) |
| ***F28D 7/08*** | (2006.01) |
| ***F28F 1/32*** | (2006.01) |

(52) U.S. Cl.

CPC ..... *F24F 1/0059* (2013.01); *F24F 13/22* (2013.01); *F24F 13/222* (2013.01); *F28D 1/0477* (2013.01); *F28D 7/02* (2013.01); *F28D 7/082* (2013.01); *F28F 1/32* (2013.01); *F28F 13/06* (2013.01); *F28F 17/005* (2013.01)

(58) Field of Classification Search

None

See application file for complete search history.

(56) References Cited

U.S. PATENT DOCUMENTS

| | | | |
|---|---|---|---|
| 3,212,288 | A | 10/1965 | Herbert |
| 3,831,670 | A | 8/1974 | Mullings |
| 4,000,779 | A | 1/1977 | Irwin |
| 4,470,271 | A | 9/1984 | Draper et al. |
| 4,574,868 | A | 3/1986 | Anders |
| 4,576,227 | A | 3/1986 | Cadars |
| 5,249,433 | A | 10/1993 | Hardison et al. |

(Continued)

OTHER PUBLICATIONS

PCT Invitation to Pay Additional Fees and, Where Applicable, Protest Fee; Application No. PCT/US2012/072145; dated Jul. 30, 2013; 6 pages.

(Continued)

*Primary Examiner* — Allen Flanigan

(74) *Attorney, Agent, or Firm* — Conley Rose, P.C.; J. Robert Brown, Jr.

(57) ABSTRACT

A HVAC system includes a cabinet configured as a duct, a coil assembly disposed within the cabinet, and at least one barrier configured to substantially segregate a low pressure zone associated with a downstream side of a heat exchanger of the coil assembly from a high pressure zone, wherein a leakage path is provided between the high pressure zone and the low pressure zone.

20 Claims, 6 Drawing Sheets

(56) References Cited

U.S. PATENT DOCUMENTS

| | | | |
|---|---|---|---|
| 5,682,754 | A | 11/1997 | Groenewold |
| 5,904,053 | A | 5/1999 | Polk et al. |
| 5,979,171 | A | 11/1999 | Mitchell et al. |
| 6,330,807 | B1 | 12/2001 | Correa et al. |
| 6,606,878 | B1 | 8/2003 | Phillips et al. |
| 7,370,489 | B2 | 5/2008 | Rios et al. |
| 9,279,620 | B2 | 3/2016 | Edens et al. |
| 2007/0012060 | A1 | 1/2007 | Simons |
| 2007/0169496 | A1 | 7/2007 | Rios et al. |
| 2008/0164006 | A1 | 7/2008 | Karamanos |
| 2012/0159981 | A1 | 6/2012 | Beck et al. |

OTHER PUBLICATIONS

PCT International Search Report; PCT Application No. PCT/US2012/072145; dated Oct. 25, 2013; 7 pages.

PCT Written Opinion of the International Searching Authority; PCT Application No. PCT/US2012/072145; dated Oct. 25, 2013; 9 pages.

Office Action dated Mar. 26, 2015; U.S. Appl. No. 13/730,584, filed Dec. 28, 2012; 7 pages.

Office Action dated Jul. 6, 2015; U.S. Appl. No. 13/730,584, filed Dec. 28, 2012; 22 pages.

Notice of Allowance dated Nov. 13, 2015; U.S. Appl. No. 13/730,584, filed Dec. 28, 2012; 7 pages.

SYSTEM AND METHOD FOR HVAC CONDENSATE MANAGEMENT

CROSS-REFERENCE TO RELATED APPLICATIONS

This is a divisional application of the prior filed and co-pending U.S. patent application Ser. No. 13/730,584 filed on Dec. 28, 2012 by John Raymond Edens, et al., entitled "System and Method for HVAC Condensate Management," which claims priority to U.S. Provisional Patent Application No. 61/581,882, filed on Dec. 30, 2011 by John Raymond Edens, et al., entitled "Compact V Oriented Evaporator," the disclosures of which are hereby incorporated by reference in their entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some HVAC systems are configured to blow air through an air handler and/or associated evaporator coil at relative high velocities capable of causing undesirable downstream migration of condensation into ductwork or otherwise away from condensation management features.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In some cases, an HVAC system may comprise an evaporator coil assembly configured for relatively high airflow velocity and configured for use in a plurality of spatial orientations. In some cases, when a relatively smaller heat exchanger face area is combined with relatively higher airflow velocity to maintain a high ratio between capacity output and heat exchanger face area, may tend to carry condensate away from condensation management components and/or carry condensate out of the evaporator coil assembly and downstream into ductwork or other downstream HVAC system components. Accordingly, in some embodiments, this disclosure provides condensation management components and/or features configured to retain condensate within the control of condensation management components while implementing the above-described higher velocity airflow through the evaporator coil assembly.

Figure 1:
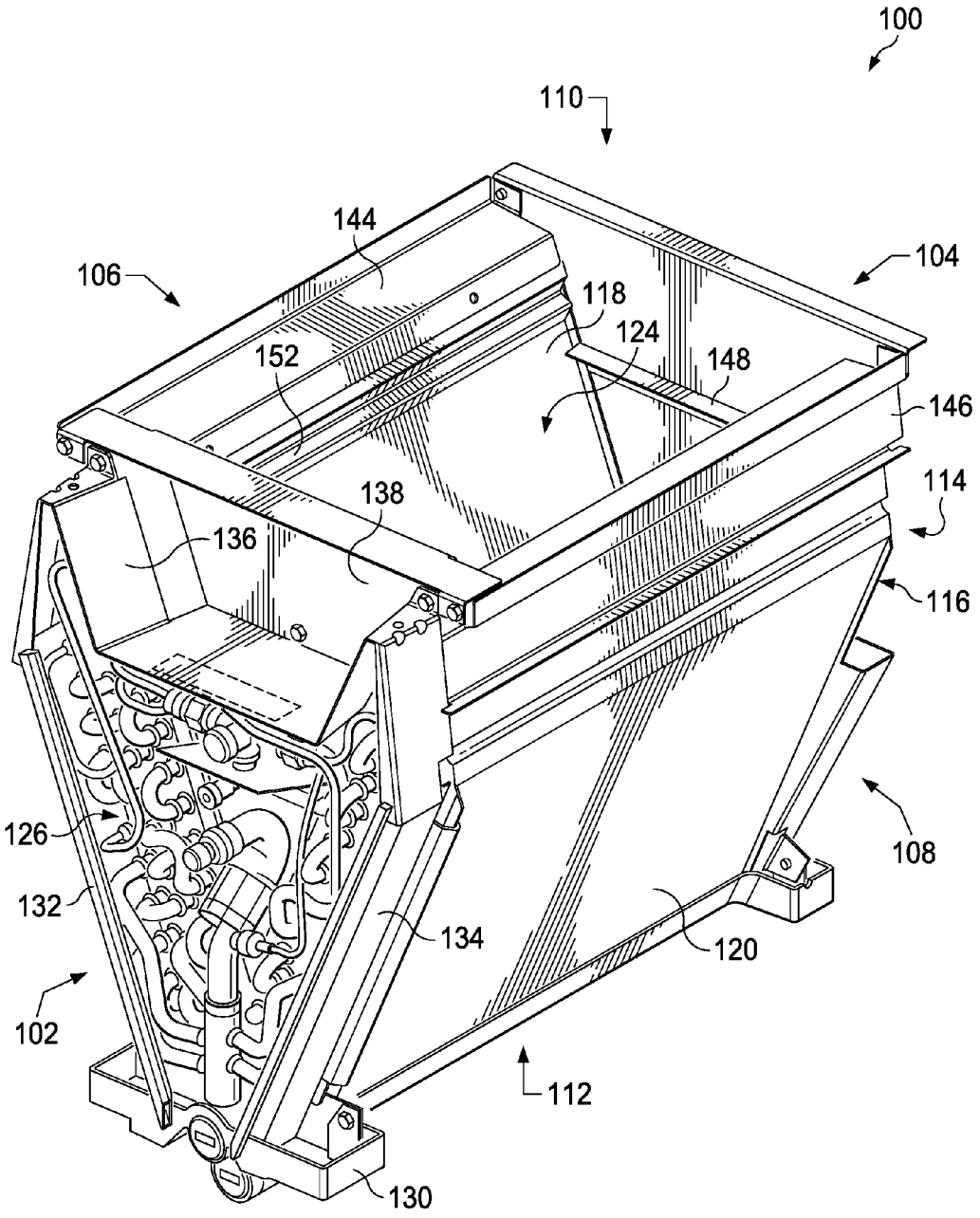
FIG. 1 is an oblique front-top-right view of an HVAC system comprising a v-shaped heat exchanger and associated condensate management components according to an embodiment of the disclosure.
Figure 2:
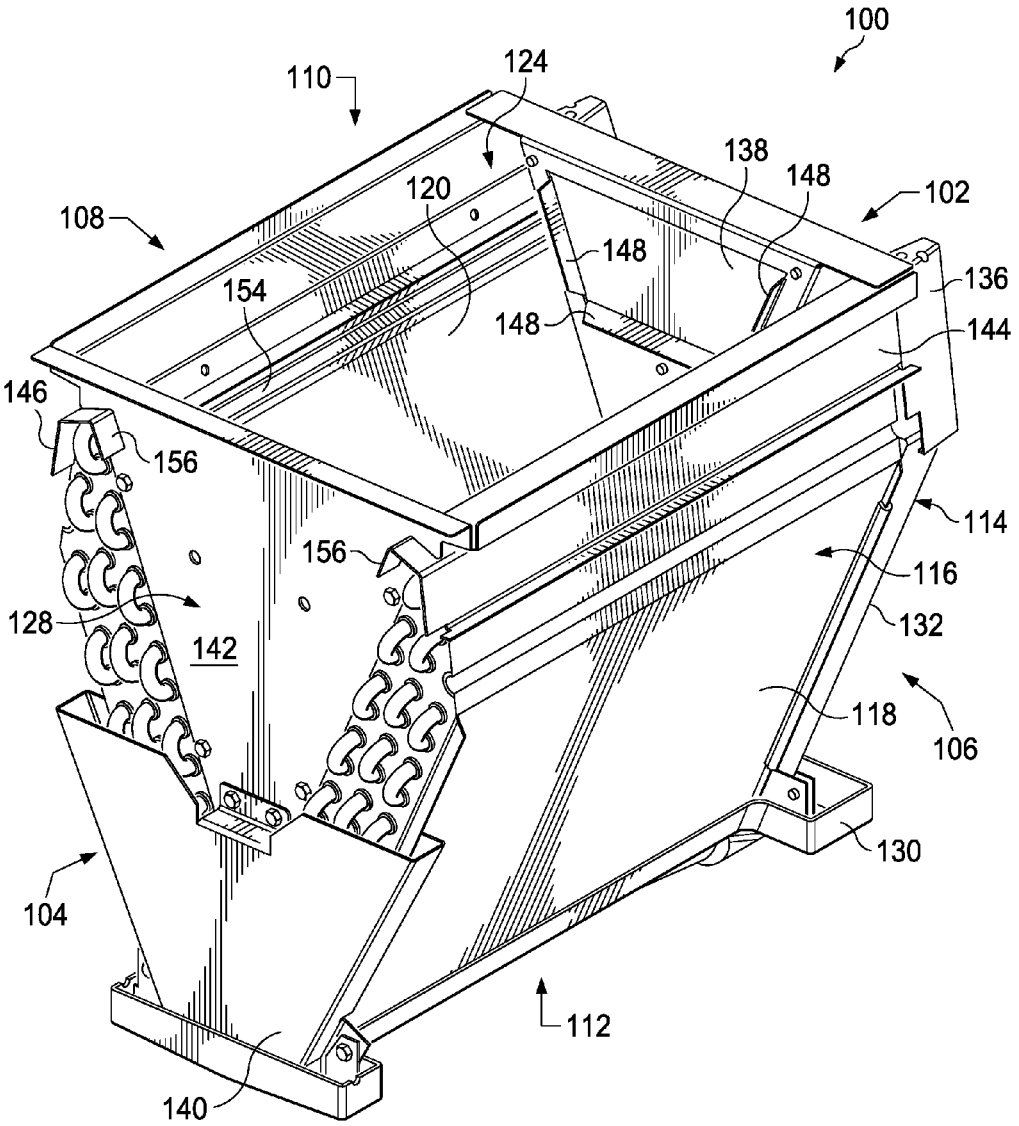
FIG. 2 is an oblique rear-top-left view of the HVAC system of FIG. 1.
Figure 3:
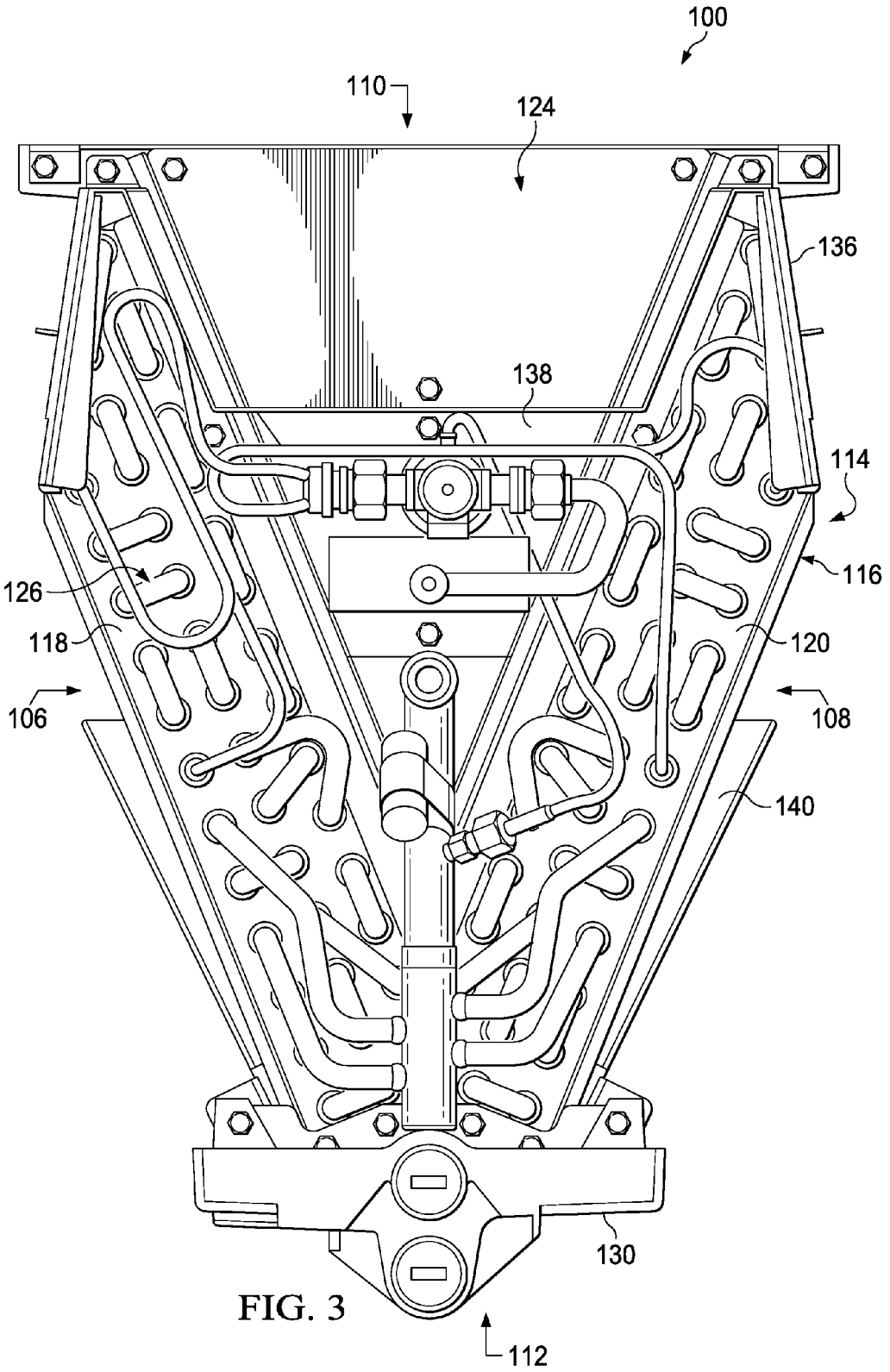
FIG. 3 is an orthogonal front view of the HVAC system of FIG. 1 with some condensate management components removed.
Figure 4:
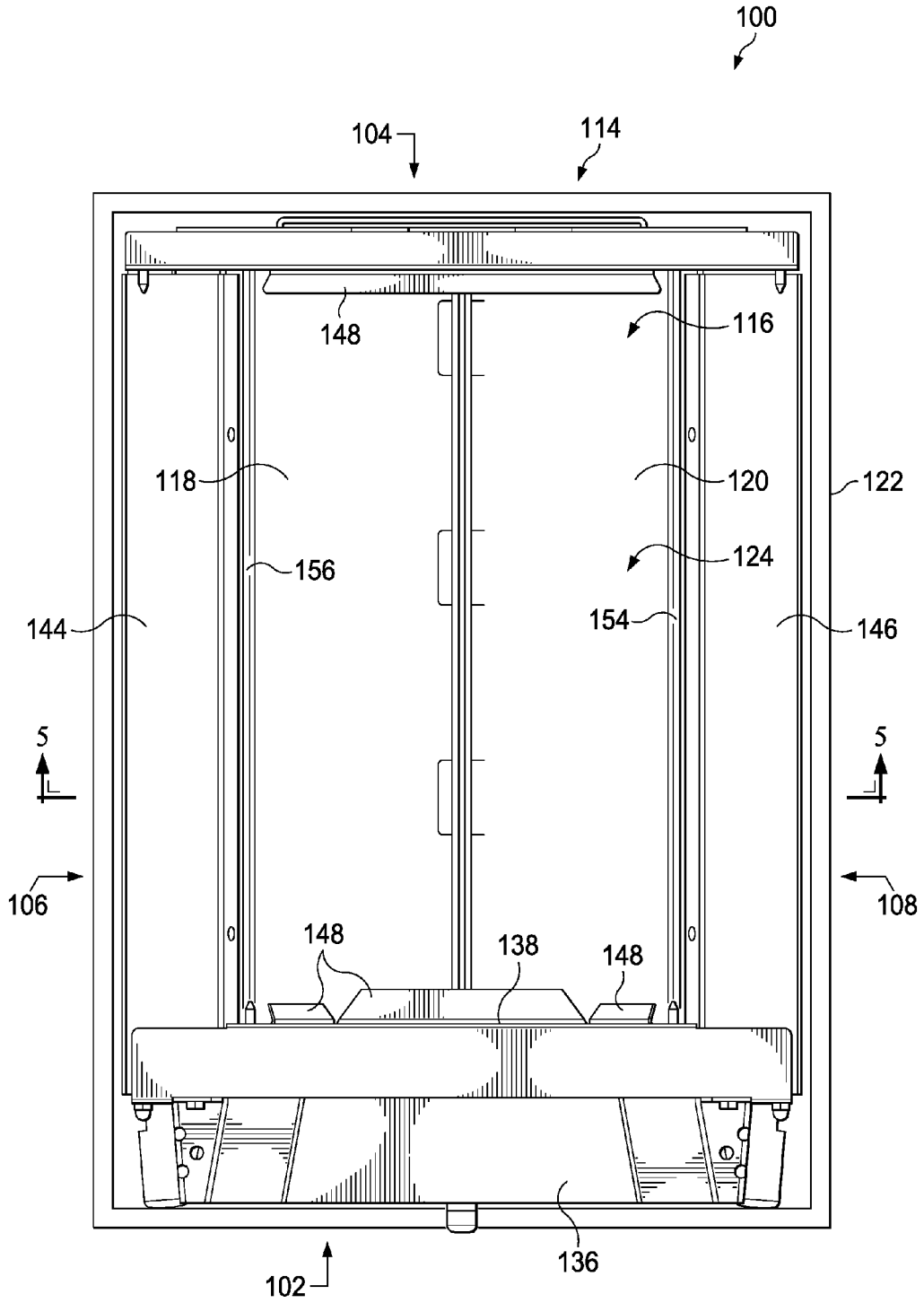
FIG. 4 is an orthogonal top view of the HVAC system of FIG. 1.
Figure 5:
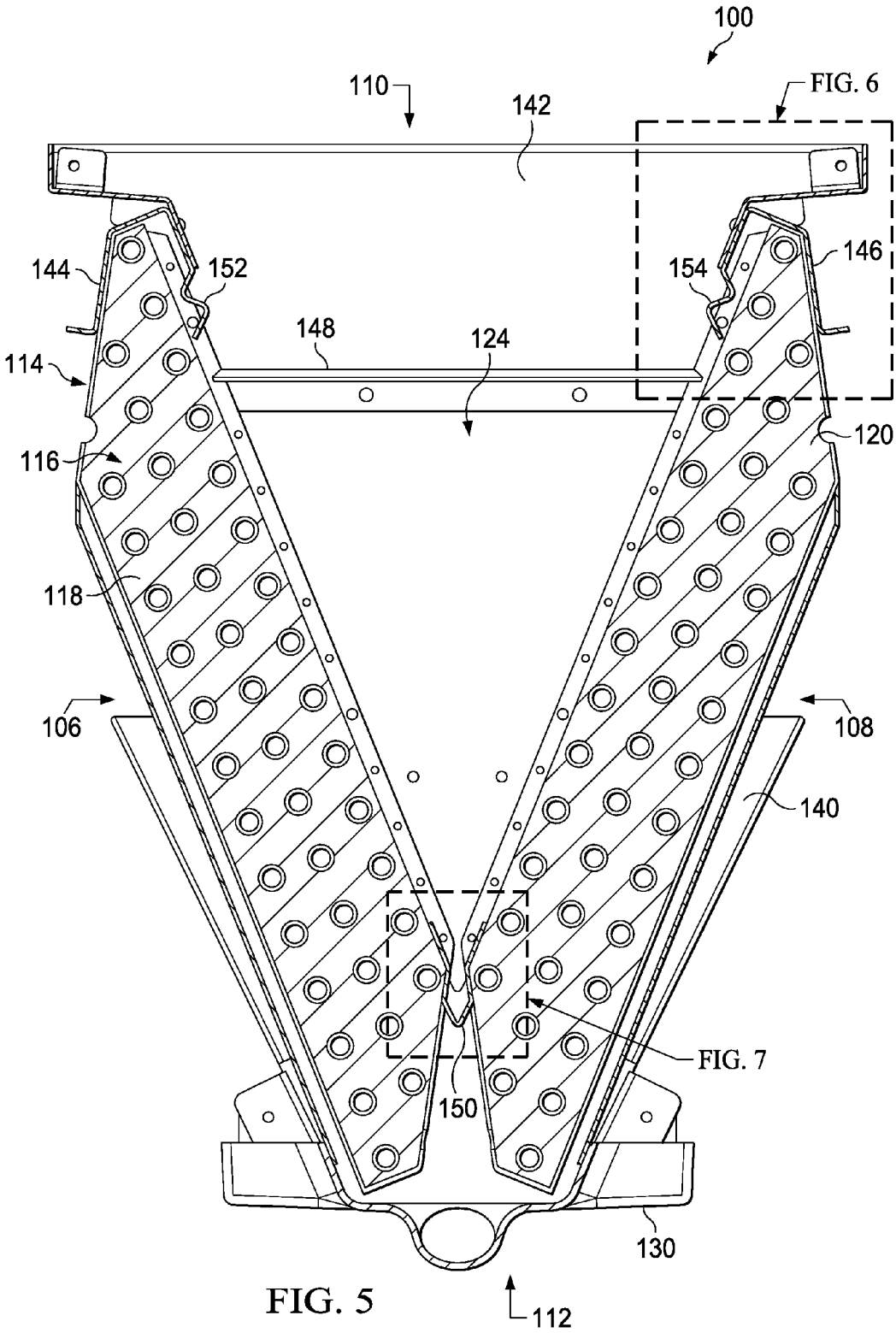
FIG. 5 is an orthogonal front cross-sectional view of the HVAC system of FIG. 1.
Figure 6:
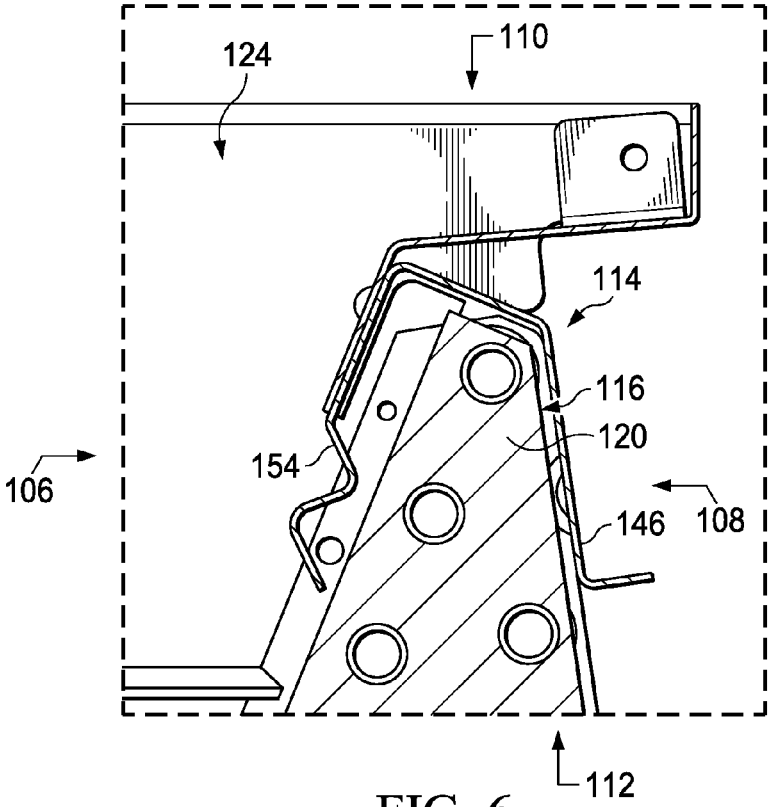
FIG. 6 is an orthogonal front close-up view of a portion of the HVAC system of FIG. 5.
Figure 7:
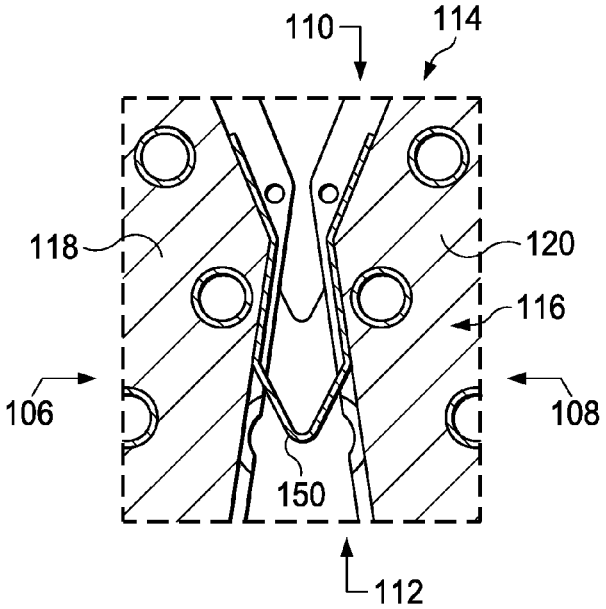
FIG. 7 is an orthogonal front close-up view of a portion of the HVAC system of FIG. 5.

Referring now to FIGS. 1-7, a portion of an HVAC system 100 comprising a coil assembly, such as, but not limited to, an evaporator coil assembly, is shown. The HVAC system 100 may generally be referred to as comprising a front 102, rear 104, left 106, right 108, top 110, and bottom 112. In some embodiments, the HVAC system 100 may be configured so that the top 110 is vertically above the bottom 112 so that gravity may draw condensate from top to bottom. Most generally, the portion of the HVAC system 100 shown comprises a coil assembly 114 comprising a V-shaped heat exchanger 116 comprising a left slab 118 and a right slab 120. The coil assembly 114 may further comprise other components configured to manage condensate by altering a pressure or airflow. Most generally, the coil assembly 114 may be dispose within a cabinet 122 (see FIG. 4) and/or other duct. In operation, the coil assembly 114 may manage condensation formed on components of the coil assembly 114 by dividing the space within the cabinet 122 into a plurality of pressure zones and providing a pressure tap and/or pressure leak path between pressure zones to selectively introduce airflow from a relatively higher pressure zone into a relatively lower pressure zone. In some embodiments, the relatively higher pressure zone may be associated with a space downstream relative to the heat exchanger 116 while the relatively higher pressure zone may be associated with spaces exterior to the heat exchanger 116 and/or located upstream of the heat exchanger 116.

While not necessarily sealed relative to either the cabinet 122 walls and/or each other, the coil assembly 114 may generally divide a space within the cabinet 122 into a plurality of pressure zones. In some embodiments, a low pressure zone 124 that is associated with a downstream portion of primary airflow through the heat exchanger 116 and which generally provides high velocity airflow. In some embodiments, a front high pressure zone 126 and a rear high pressure zone 128 may be formed between a portion of the coil assembly 114 and the front wall of the cabinet 122 and rear wall of the cabinet 122, respectively.

The front high pressure zone 126 may generally be located between the front of the heat exchanger 116 and the front wall of the cabinet 122. The front high pressure zone 126 may generally be enveloped and/or substantially segregated from surrounding pressure zones by a front wall of the cabinet 122, a drain pan 130 that comprises a central aperture for airflow therethrough, a left barrier 132 (not shown in FIG. 3), a right barrier 134 (not shown in FIG. 3), an upper barrier 136, and a rear barrier 138. Because the front high pressure zone 126 does not receive a significant portion of the primary airflow and is not substantially open to the low pressure zone 124, the front high pressure zone 126 may comprise a substantially higher air pressure relative to the low pressure zone 124.

The rear high pressure zone 128 may generally be located between the rear of the heat exchanger 116 and the rear wall of the cabinet 122. The rear high pressure zone 128 may generally be enveloped and/or substantially segregated from surrounding pressure zones by rear, left, and right walls of the cabinet 122, the drain pan 130, a lower barrier 140, and an upper barrier 142. Because the rear high pressure zone 128 does not receive a significant portion of the primary airflow and is not substantially open to the low pressure zone 124, the rear high pressure zone 128 may comprise a substantially higher air pressure relative to the low pressure zone 124. In some embodiments, the front and rear high pressure zones 126, 128 may be in substantial fluid communication with each other and therefor may comprise substantially the same air pressure. Further, in some embodiments, the cabinet 122 may be conceptualized as comprising a single low pressure zone, such as low pressure zone 124, that is associated with the downstream output of airflow from the heat exchanger 116 while a remainder of the interconnected and/or unsegregated interior space within the cabinet 122 may form a singular or interconnected high pressure zone that may be pressurized by an output of a blower assembly.

The primary airflow through the low pressure zone 124 may be impeded from exiting a top end of the left slab 118 and right slab 120 by a left slab cap 144 and a right slab cap 146, respectively. The left and right slab caps 144, 146 may be shaped to complement an upper end of the left and right slabs 118, 120, respectively so that air that encounters the left and right slab caps 144, 146 from below may be redirected along a front-rear length of the left and right slab caps 144, 146 and/or may otherwise experience a change in direction. The primary airflow through the low pressure zone 124 may additionally be impeded, redirected, and/or disturbed by inward protrusions 148 of rear barrier 138 and/or upper barrier 142, a slab joint 150, a left disturber 152, and/or a right disturber 154. The slab joint (shown in greater detail in FIG. 7) may block free passage of air between adjacent bottom ends of the left and right slabs 118, 120. The inward protrusions 148 may generally disturb airflow near the front and back of the airflow and may locally reduce air velocity adjacent the inward protrusions 148 to at least one of redirect airflow and/or provide a the reduced air velocity that may be less likely to carry air laden with condensation.

The left disturber 152 and right disturber 154 may be configured to disturb airflow near an upper portion of the interior facing side of each of the left slab 118 and right slab 120, respectively. In some cases, an undulating, saw-tooth shaped, and/or s-shaped step and/or series of steps may be disposed adjacent the slabs 118, 120 to locally reduce a velocity of airflow so that the airflow in the reduced velocity regions may be less likely to carry air laden with condensation and/or so that condensation is less likely to be transported through the lower velocity regions.

Further, in some embodiments, the left and right slab caps 144, 146 may extend through the rear barrier 138 associated with the front high pressure zone 126 and/or the upper barrier 142 associated with the rear high pressure zone 128. In such cases, the upper barrier 142 and the rear barrier 138 may comprise slots 156 (shown in greater detail in FIG. 6) generally shaped complementary to the slab caps 144, 146 but also sized and/or shaped to provide an air leakage path, a pressure tap to the low pressure zone 124, and/or to otherwise allow air to transfer between the low pressure zone 124 and one or both of the front and rear high pressure zones 126, 128. In some cases, air may flow from front and rear high pressure zones 126, 128 via the slots 156 to the relatively lower pressure space of low pressure zone 124. In some cases, by connecting the low pressure zone 124 to the front and/or rear high pressure zones 126, 128 in the controlled manner as described above, the airflow through the slots 156 may impede, reduce, and/or prevent condensation from exiting the low pressure zone 124. In some cases, the airflow obtained via the above-described interconnection between pressure zones in combination with the velocity reduction achieved by disturbing the air with the disturbers 152, 154 may enable more condensation to remain attached to the coil assembly 114 rather than becoming entrained in the primary airflow and undesirably carried out of the coil assembly 114. The condensation that remains attached to the coil assembly 114 may accordingly be gravity driven to fall or otherwise follow component surfaces to drain pan 130. In alternative embodiments, a different number of and/or differently shaped and/or configured high pressure zones, a different number of and/or differently shaped and/or configured flow paths between pressure zones, and/or a different number of and/or differently shaped and/or configured airflow disturbers may be utilized to provide a reduction in a velocity of a portion of a downstream portion of a primary airflow.

In some embodiments, a method of condensation management may be provided. In some cases, the method may comprise substantially segregating a primary airflow zone having a relatively low pressure from a high pressure zone that may not receive a substantial portion of the primary airflow. The method may further comprise obstructing airflow from a downstream end of a coil slab. The method may further comprise locally disturbing airflow to reduce an airflow velocity near a region of a coil slab that otherwise may be associated with condensation separation from the coil slab as a result of high airflow velocity. The method may further comprise connecting a low pressure zone associated with the primary airflow downstream relative to a heat exchanger to a higher pressure zone via an air leakage path to cause an airflow that prevents condensation from traveling from the low pressure zone to the high pressure zone.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent. Of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An HVAC coil assembly, comprising:

a first slab coil and a second slab coil configured in a V-shaped coil arrangement, wherein the first slab coil and the second slab coil are configured to at least partially segregate a low pressure zone associated with a downstream side of the HVAC coil assembly from a high pressure zone;

a slab cap disposed over an upper end of each of the first slab coil and the second slab coil, each slab cap comprising at least one undulating disturber disposed near the upper end of each of the first slab coil and the second slab coil within the low pressure zone, wherein the undulating disturbers are configured locally to reduce a velocity of an airflow to reduce an amount of condensation being transported through reduced velocity regions; and an air leakage path between the low pressure zone and the high pressure zone that is configured to allow airflow to transfer from the high pressure zone to the low pressure zone to reduce an amount of condensation leaking from the low pressure zone to the high pressure zone.

2. The HVAC coil assembly of claim 1, wherein the slab cap entirely covers the upper end of each of the first slab coil and the second slab coil.

3. The HVAC coil assembly of claim 1, wherein the disturber is associated with an inner facing side of each of the first slab coil and the second slab coil.

4. The HVAC coil assembly of claim 1, wherein the disturber comprises a saw tooth profile.

5. The HVAC coil assembly of claim 1, wherein the disturber is connected to the slab cap.

6. The HVAC coil assembly of claim 1, wherein the HVAC coil assembly is disposed in a cabinet configured as a duct, and wherein the high pressure zone is located between the coil assembly and the cabinet.

7. The HVAC coil assembly of claim 1, wherein the HVAC coil assembly is disposed in a cabinet configured as a duct, and wherein the high pressure zone is located between a front of the coil assembly and a front of the cabinet.

8. The HVAC coil assembly of claim 1, wherein the HVAC coil assembly is disposed in a cabinet configured as a duct, and wherein the high pressure zone is located between a rear of the coil assembly and a rear of the cabinet.

9. The HVAC coil assembly of claim 1, wherein the air leakage path is provided through a slot in a component configured to substantially segregate the low pressure zone from the high pressure zone.

10. The HVAC coil assembly of claim 9, wherein the leakage path lies along a length of the slab caps that prevent the primary airflow from exiting an end of the first slab coil and the second slab coil.

11. The HVAC coil assembly of claim 10, wherein the velocity of the airflow is locally reduced substantially adjacent to the leakage path.

12. A HVAC system, comprising:

a cabinet configured as a duct; and a coil assembly comprising:

a first slab coil and a second slab coil configured in a V-shaped coil arrangement wherein the first slab coil and the second slab coil are configured to at least partially segregate a low pressure zone associated with a downstream side of the coil assembly from a high pressure zone;

a slab cap disposed over an upper end of each of the first slab coil and the second slab coil, each slab cap comprising at least one undulating disturber disposed near the upper end of each of the first slab coil and the second slab coil within the low pressure zone, wherein the undulating disturbers are configured locally to reduce a velocity of an airflow to reduce an amount of condensation being transported through reduced velocity regions; and an air leakage path between the low pressure zone and the high pressure zone that is configured to allow airflow to transfer from the high pressure zone to the low pressure zone to reduce an amount of condensation leaking from the low pressure zone to the high pressure zone.

13. The HVAC system of claim 12, wherein the slab cap entirely covers the upper end of each of the first slab coil and the second slab coil.

14. The HVAC system of claim 12, wherein the disturber is associated with an inner facing side of each of the first slab coil and the second slab coil.

15. The HVAC system of claim 12, wherein the high pressure zone is located between the coil assembly and the cabinet.

16. The HVAC system of claim 12, wherein the high pressure zone is located between a front of the coil assembly and a front of the cabinet.

17. The HVAC system of claim 12, wherein the high pressure zone is located between a rear of the coil assembly and a rear of the cabinet.

18. The HVAC system of claim 12, wherein the air leakage path is provided through a slot in a component configured to substantially segregate the low pressure zone from the high pressure zone.

19. The HVAC system of claim 18, wherein the leakage path lies along a length of the slab caps that prevent the primary airflow from exiting an end of the first slab coil and the second slab coil.

20. The HVAC system of claim 19, wherein the velocity of the airflow is locally reduced substantially adjacent to the leakage path.

* * * * *